United States Patent [19]

Baudin

[11] 4,118,160

[45] Oct. 3, 1978

[54] ROTARY MACHINE WITH CONTROLLED RETRACTABLE PIVOTED MEMBERS SUCH AS BLADES OR PISTONS

[75] Inventor: Lucien Baudin, Paris, France

[73] Assignee: Idram Engineering Company Est., Switzerland

[21] Appl. No.: 831,060

[22] Filed: Sep. 6, 1977

[30] Foreign Application Priority Data

Oct. 11, 1976 [CH] Switzerland ..... 12847/76

[51] Int. Cl.[2] ..... F04C 29/10

[52] U.S. Cl. ..... 418/260

[58] Field of Search ..... 418/259, 260, 262, 265, 418/261

[56] References Cited

U.S. PATENT DOCUMENTS

| | | | |
|---|---|---|---|
| 119,714 | 10/1871 | O'Leary | 418/260 |
| 704,913 | 7/1902 | Palle | 418/265 X |
| 822,343 | 6/1906 | Cagle | 418/260 X |
| 883,464 | 3/1908 | Leiman et al. | 418/260 |
| 945,746 | 1/1910 | Bratschie | 418/260 X |
| 1,750,502 | 3/1930 | Baker | 418/261 |
| 1,995,755 | 3/1935 | Smith | 418/260 |
| 2,720,191 | 10/1955 | Vas | 418/260 |

FOREIGN PATENT DOCUMENTS

| | | | |
|---|---|---|---|
| 458,074 | 6/1950 | Italy | 418/260 |

*Primary Examiner*—Carlton R. Croyle
*Assistant Examiner*—Leonard E. Smith
*Attorney, Agent, or Firm*—Stevens, Davis, Miller & Mosher

[57] ABSTRACT

A rotary machine such as a pump, compressor or internal combustion engine comprises blades or pistons pivotally mounted on a rotor for cooperation with an inner cylindrical wall of a stator. A mechanism controlling the angular position of the blades or pistons comprises at least one arm fastened to the corresponding blade or piston and comprising a surface cooperating under the action of centrifugal force with a surface of revolution whose axis is eccentric in relation to the axis of the rotor.

2 Claims, 4 Drawing Figures

ROTARY MACHINE WITH CONTROLLED RETRACTABLE PIVOTED MEMBERS SUCH AS BLADES OR PISTONS

The present invention relates to a rotary machine with controlled, retractable members, such as blades or pistons, particularly for a vacuum pump, a volumetric pump, a volumetric compressor, or an internal combustion engine, comprising a rotor, blades or pistons mounted for pivoting on the rotor, a stator inside which the rotor turns, with the blades or pistons cooperating with the inside cylindrical wall of the stator, and a mechanism controlling the angular portion of the blades or pistons in relation to their pivoting axis on the rotor.

The present invention is a modification or improvement of the machine described and claimed in U.S. application No. 693.628.

Various solutions have already been proposed for controlling the displacements of the blades in relation to the inner surface of the stator and in relation to their pivoting axis.

In certain known rotary machines the mechanism controlling the angular position of the blades is mounted centrally inside the rotor. A mechanism of this kind may comprise a plurality of connecting rods mounted on an eccentric, each rod being connected directly to a blade.

A rotary internal combustion engine has already been proposed in which the blades are displaceable either by centrifugal force or by a mechanism comprising gear wheels meshing with a toothed ring on the stator.

In another type of rotary internal combustion engine the blades mounted for pivoting on the rotor are controlled by a connecting rod mechanism intended to bring the blade constantly into contact with the inner surface of the stator in order to form a fluid-tight chamber. The blades are here controlled by means of an eccentric driven by a pinion meshing with a central toothed wheel fastened on the stator shaft. These gear wheels are mounted on the centre of the rotor.

It is also known to control the pivoting blades on the rotor with the aid of a transmission system comprising, on each side of the rotor, gear wheels driving pistons connected to the blades, these gear wheels coming into engagement with a pinion fastened on the stator shaft.

In another known rotary machine the oscillations of the blades are guided in known manner with the aid of a groove of elliptical shape formed in each side wall of the stator, guide shoes or slides connected to the blades moving in these grooves.

In another known construction the elliptical grooves are replaced by eccentric grooves, in which move parts fastened to the blades.

Generally speaking, the rotary machines proposed up to the present time are of complicated and expensive construction, entailing a large number of mechanical members, which necessarily have the effect of increasing friction and consequently of reducing the performance of the machine. Another disadvantage of these known constructions consists in that the speeds of rotation are limited.

Moreover, in the prior art it is blades and not pistons that are guided.

It also occurs that in certain types of known rotary machines the blades are ejected by centrifugal force and are caused to bear against the inner surface of the stator or are wedged in their sockets.

The invention forming the object of the U.S. Patent application No. 693.628 seeks to provide a remedy for these disadvantages.

It relates to a rotary machine with supported and controlled retractable members, such as blades or pistons, particularly for a vacuum pump, a volumetric pump, a volumetric compressor, or an internal combustion engine, comprising a rotor, blades or pistons mounted for pivoting on the rotor, a stator inside which the rotor turns, with the blades or pistons cooperating with the inner cylindrical wall of the stator, and a mechanism controlling the angular position of the blades or pistons in relation to their pivoting axis on the rotor, wherein the mechanism controlling the angular position of the retractable members comprises at least one connecting rod connected directly to a shaft which is eccentric in relation to the rotor shaft, and wherein the connecting rod is articulated to a lever fixed on the pivot pin of the corresponding retractable member.

The present invention seeks to improve more particularly small machines of this type which are equipped with blades, by proposing a more economical solution for the control mechanism.

It relates to a rotary machine having supported, controlled retractable blades, particularly for a vacuum pump, a volumetric pump, a volumetric compressor, or an internal combustion engine, comprising a rotor, blades mounted for pivoting on the rotor, a stator inside which the rotor turns, with the blades or pistons cooperating with the inner cylindrical wall of the stator, and a mechanism controlling the angular position of the blades in relation to their pivoting axis on the rotor, wherein the mechanism controlling the angular position of the retractable members comprises at least one arm fastened to the corresponding retractable member and having a surface cooperating under the action of centrifugal force with a surface of revolution whose axis is eccentric in relation to the axis of the rotor.

In the patent application the connecting rod-lever articulation describes a circle about the eccentric axis on which the other end of the connecting rod is mounted for pivoting. This is a kinematically determined trajectory.

In the present invention there also exists a point of the lever which describes a circle about the eccentric axis, so that the trajectory is the same but is determined by the combination of a kinematic effect, centrifugal force, and a kinematic limitation defined by the surface of revolution.

The invention will be better understood with the aid of the description of one embodiment given by way of example and with reference to the drawing, in which.

Figure 1:
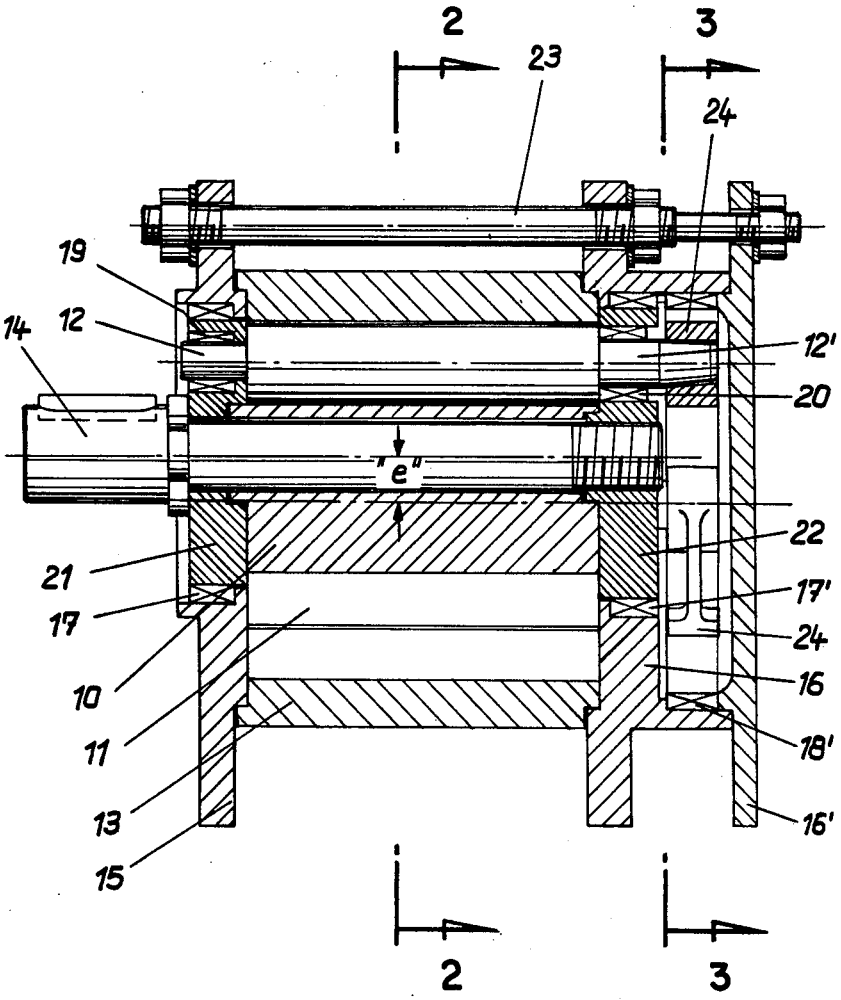
FIG. 1 is a view in axial section on the line 1—1 in FIG. 2.

The rotary machine shown comprises a rotor 10 provided with retractable blades 11 mounted for pivoting about pins 12, 12', and a stator 13 inside which the rotor 10 turns.

The rotor is mounted at one end on a drive shaft 14, whose geometrical axis is eccentric in relation to the geometrical axis of the stator 13, and at the other end on a support element 22 disposed in a plate 16 fixed to the stator 13.

Figure 2:
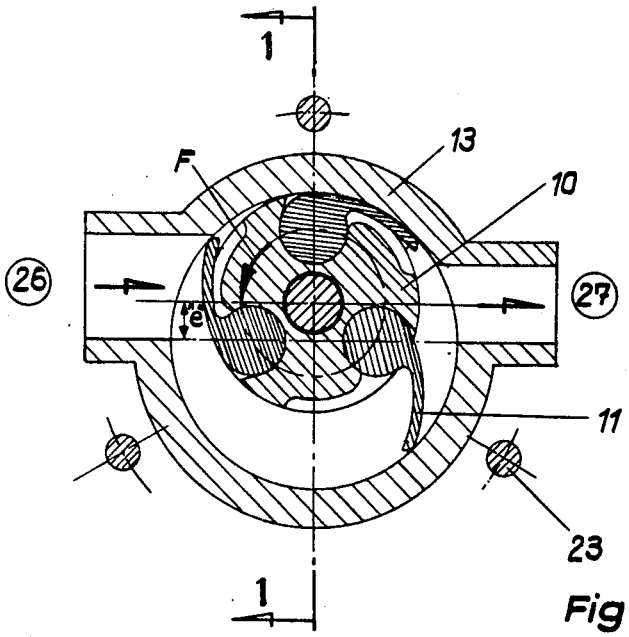
FIG. 2 is a cross-section on the line 2—2 in FIG. 1.
Figure 3:
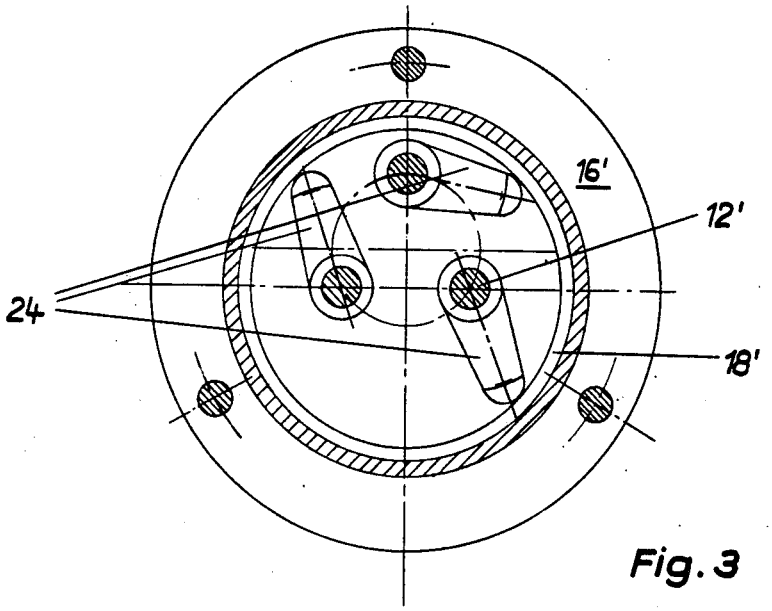
FIG. 3 is a cross-section on the line 3—3 in FIG. 1, showing the control mechanism and the supporting of the blades.
Figure 4:
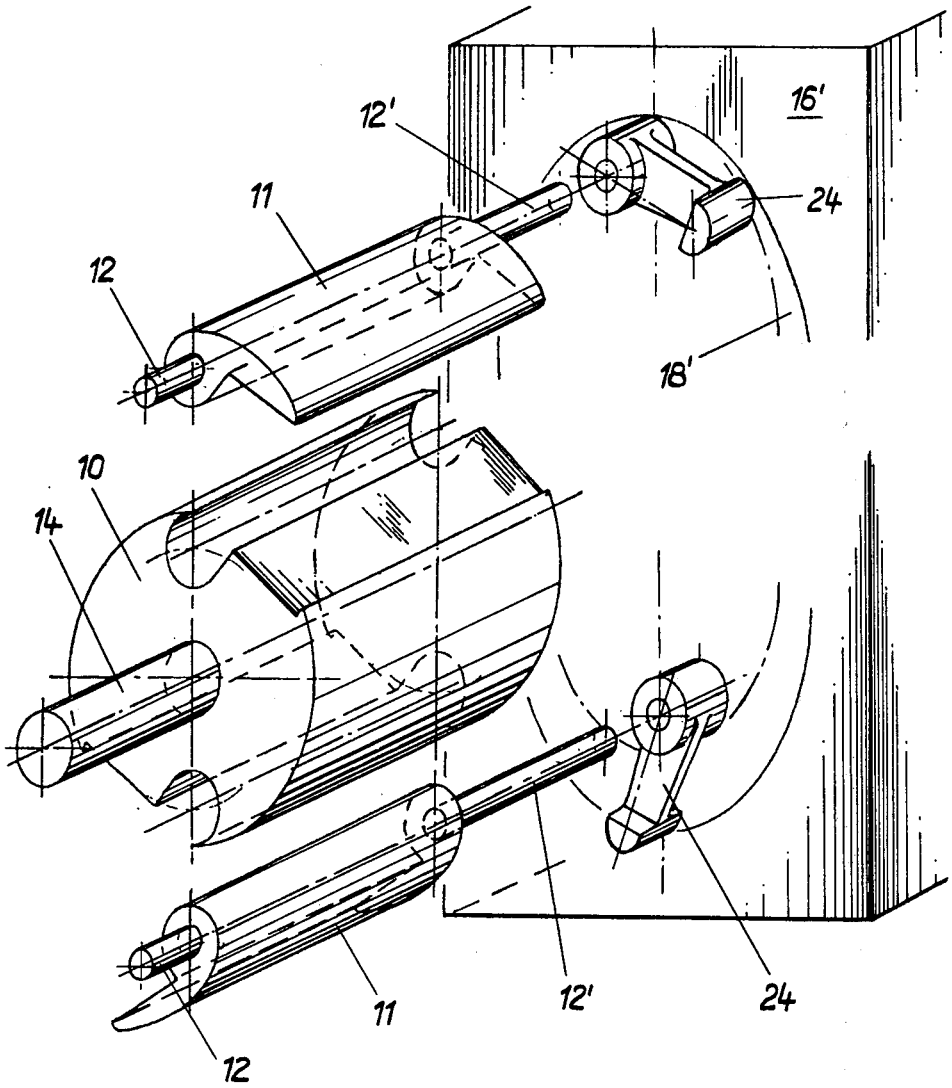
FIG. 4 is an explosed view in perspective of the embodiment shown in FIGS. 1, 2 and 3.

In FIGS. 1 and 2 the eccentricity is indicated by the distance "*e*" separating the two geometrical axes. The stator 13 has side plates 15 and 16.

The plate 15 supports the bearing 17 of the shaft 14 of the rotor 10, and the plate 16 supports a bearing 17' for the support element 22 fastened to the rotor 10, and also a guide crown 18' for controlling the angular position of the blades 11.

The cover 16' encloses the mechanism controlling the angular position of the blades 11 about their pivot pins 12, 12'. It will be noted that these pivot pins 12, 12' are parallel to the shaft 14 of the rotor 10, and that the pin 12' is longer than the pin 12.

The cover 16' may be so constructed as to hold the arms 24 in position during the stationary phase of the machine shown.

The circular plate 21 supports bearings 19 for the pins 12 of the blades. At the other end of the rotor 10 the pins 12' are supported by bearings 20 mounted on the circular support 22 mounted for rotation on the bearing 17' in the plate 16 fastened to the stator.

The plates 15 and 16 are fastened to the stator 13 by means of fastening rods 23, which also fasten the cover 16'.

The circular supports 21, 22 are fastened to the rotor 10 by the shaft 14, which is threaded at its end and screwed onto the support 22.

The mechanism controlling the retractable blades 11 comprises, for each blade, an arm 24 held at its end on the pin 12'.

In FIG. 1 the arm is shown secured by a conical fit.

FIG. 2 shows the application of the machine to a compressor in which the stator 13 has a suction aperture 26 and a delivery or exhaust aperture 27. These apertures extend over the entire length of the inside wall of the stator 13 swept by the blades 11.

The operation of the rotary machine described is as follows.

The rotor 10 is rotated in the direction of the arrow F by the drive shaft 14 coupled to a motor (not shown). This rotational movement is transmitted to the blades 11, whose pins 12' in turn drive the arms 24, which under the action of centrifugal force bear against the guide crown 18' in such a manner that the end of each blade 11 is displaced tangentially to the inner cylindrical surface of the stator 13 during the rotation of the rotor 10.

It will be noted that scrapers may be provided in order to supplement tightness. Moreover, the number of blades could be modified without departing from the scope of the invention.

One advantage of rotary machines of the type described is the suppression of all friction between the blade and the stator or between the blade and the socket, without tightness being impaired.

Another advantage consists of the simplicity of the construction and of the fact that no forced lubrication with oil or water is required in the working chamber. Moreover, the mechanical control members are perfectly isolated from the working chamber, so that they can be lubricated in a rational manner. In addition, the machines described can operate at very high rotational speeds, with an improvement of performance and a considerable reduction of weight and dimensions for the same flow/pressure values as known machines.

Various materials may be used for the production of the parts of the machines described, particularly plastics materials such as polytetrafluoroethylene, glass-epoxy, thus gaining the advantage of eliminating lubrication of rotating parts and enabling the cost of production to be reduced. All in all, a saving of energy is achieved in the driving of the machine. Obviously it is also possible to use a metal, for example aluminium or any other light metal.

These machines can be used to produce suction or compression, to supply a fixed or variable volumetric flow, whatever the nature of the fluid or gas.

Because of their small dimensions the machines described will also advantageously be used as anti-pollution pumps for motor vehicles; as compressors for air conditioning in general and for motor vehicles in particular; as pumps for any installation intended to convert energy in any form; as rotary compressed air motors for pneumatic tools; as pumps and vacuum pumps in the field of the chemical industry, foodstuffs industry, or medical industry, where in particular corrosive materials are handled.

What is claimed is:

1. A rotary machine with controlled retractable blades or pistons, and comprising a rotor, the blades being pivotally mounted on the rotor, a stator inside which the rotor turns, with the blades or pistons cooperating with the inside cylindrical wall of the stator, and a mechanism controlling the angular position of the blades in relation to their pivoting axis on the rotor, wherein the mechanism controlling the angular position of the retractable members comprises at least one arm fastened to the corresponding retractable member and comprising a surface cooperating under the action of centrifugal force with a surface of revolution whose axis is eccentric in relation to the axis of the rotor.

2. A machine according to claim 1 wherein the mechanism controlling the angular position of the retractable members is disposed laterally in relation to the rotor, in a space provided in a side cover of the stator at one end of the rotor.

* * * * *

UNITED STATES PATENT AND TRADEMARK OFFICE

CERTIFICATE OF CORRECTION

PATENT NO. : 4,118,160

DATED : October 3, 1978

INVENTOR(S) : Lucien BAUDIN

It is certified that error appears in the above-identified patent and that said Letters Patent are hereby corrected as shown below:

Please correct the address of the Assignee to read "LIECHTENSTEIN" as the country and not Switzerland.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*